US009541304B2

(12) United States Patent
Rissler et al.

(10) Patent No.: US 9,541,304 B2
(45) Date of Patent: Jan. 10, 2017

(54) WATER HEATER WITH CENTERING THERMAL BREAK SUPPORT

(71) Applicant: General Electric Company, Schenectady, NY (US)

(72) Inventors: Christopher Bryan Rissler, La Grange, KY (US); Jonathan D. Nelson, Louisville, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 166 days.

(21) Appl. No.: 14/565,790

(22) Filed: Dec. 10, 2014

(65) Prior Publication Data

US 2016/0169555 A1 Jun. 16, 2016

(51) Int. Cl.
*F24H 9/02* (2006.01)

(52) U.S. Cl.
CPC ..... *F24H 9/02* (2013.01)

(58) Field of Classification Search
CPC . F22B 37/36; Y10T 29/4935; Y10T 29/49895
USPC ..... 122/19.2, 494, 234; 220/567.3, 694.1, 220/592.2
See application file for complete search history.

(56) References Cited

U.S. PATENT DOCUMENTS 2,303,126 A * 11/1942 Koppel ..... F24H 1/182 220/567.3
2,324,710 A * 7/1943 Livar ..... F24H 9/02 126/114
3,110,797 A * 11/1963 Vanne ..... A61H 33/063 122/40
4,520,795 A * 6/1985 Parkyn ..... F24J 2/055 126/610
5,115,767 A * 5/1992 West ..... B29C 44/1242 122/19.2
5,154,140 A 10/1992 Windon
5,924,392 A * 7/1999 Hall ..... F24H 1/182 122/494
6,267,261 B1 * 7/2001 Lesage ..... F24H 1/182 220/567.3
7,765,959 B2 * 8/2010 Syler ..... F24H 1/182 122/19.2
9,222,697 B2 * 12/2015 Rodriguez ..... F24H 1/181
2012/0128337 A1 * 5/2012 Rahmani ..... F24H 1/181 392/441
2013/0340690 A1 12/2013 Rodriguez et al.
2014/0158066 A1 * 6/2014 Kanagala ..... B21C 37/15 122/234

* cited by examiner

*Primary Examiner* — Gregory A Wilson
(74) *Attorney, Agent, or Firm* — Dority & Manning, P.A.

(57) ABSTRACT

A water heater is provided that includes a centering ring or thermal barrier that facilitates centering or alignment of a tank of the water heater while also diminishing heat loss through the bottom of the tank. Features are provided with centering ring that keep the centering ring in place and help prevent insulation from intruding under the centering ring and the tank of the water heater.

18 Claims, 5 Drawing Sheets

WATER HEATER WITH CENTERING THERMAL BREAK SUPPORT

FIELD OF THE INVENTION

The subject matter of the present disclosure relates generally to water heaters.

BACKGROUND OF THE INVENTION

Water heaters can provide for the heating and storage of water to be used in, e.g., a residential or commercial structure. A heat source is provided for raising the temperature of water in a water tank. The heat energy may be supplied e.g., by gas burners, electrically-resistant coils, or a heat pump using a refrigerant cycle. Typically, the water tank is surrounded by a wrapper and is insulated to allow storage of the heated water until use. However, a significant heat loss can also occur through the bottom of the tank, where insulation may not be installed and where contact may be made directly with, e.g., the ground, a concrete floor, or other surface that can conduct heat away from the tank.

A water heater is generally provided with an inlet for receipt of unheated water and with an outlet for delivery of heated water. During installation, the inlet and outlet are connected with, e.g., the piping system of a residential or commercial structure. Depending upon the location of the inlet and outlet connections on the water heater, additional piping and/or modifications to the existing piping system may be necessary for both original installations as well as replacement installations to connect with such piping system. Further, because the locations of the inlet and outlet may vary between different water heaters of the same capacity, particularly when provided by different manufacturers, each installation can require different materials and configurations customized to such installation—thereby increasing the costs of the installation. Thus, a standardized tank position is desirable.

Typically, a plastic ring is provided to space the tank from a bottom cover and act as a thermal break, and a foam ring is provided to keep the tank centered in the bottom cover and to keep insulation, such as, e.g., a foamed-in insulation, from intruding under the tank. Requiring a ring as a thermal break and a separate ring as a centering element to standardize the tank position adds extra manufacturing cost to the water heater, such as added costs to make and assemble the water heater with a second ring.

Accordingly, a water heater having one or more features that help insulate and center the water tank would be useful. A centering ring for a water heater having one or more features for insulating and centering the water tank would also be beneficial.

BRIEF DESCRIPTION OF THE INVENTION

A water heater is provided that includes a centering ring or thermal barrier that facilitates centering or alignment of a tank of the water heater while also diminishing heat loss through the bottom of the tank. Features are provided with centering ring that keep the centering ring in place and help prevent insulation from intruding under the centering ring and the tank of the water heater. Additional aspects and advantages of the invention will be set forth in part in the following description, or may be apparent from the description, or may be learned through practice of the invention.

In one exemplary embodiment, a water heater is provided. The water heater includes a tank having a bottom and defining a chamber for heating water. The tank also defines a vertical direction and a radial direction. The water heater further includes a heating source in thermal communication with the tank; a wrapper surrounding at least a portion of the tank, the wrapper having a bottom opening; a bottom cover positioned at the bottom opening of the wrapper to close off the bottom opening; and a centering ring onto which the bottom of the tank is positioned. The centering ring includes an inner lead-in surface, an outer lead-in surface, and a base surface defining a pocket. The pocket extends circumferentially about the centering ring, and the base surface defines a pocket crush rib. The centering ring further includes a sealing flange defining a flange crush rib and a plurality of arms extending along a radial direction from the sealing flange.

In another exemplary embodiment, a water heater is provided. The water heater includes a tank for storing water, the tank having a bottom edge and defining a vertical direction and a radial direction; a casing surrounding the tank and defining an interior between the tank and the casing, the casing comprising a wrapper; insulation positioned in the interior; and a centering ring onto which the tank is positioned. The centering ring includes a pocket into which the bottom edge of the tank is received, the pocket defining a pocket crush rib; a sealing flange extending about the circumference of the centering ring, the sealing flange defining a flange crush rib; and a plurality of arms spaced apart along the circumference of the centering ring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
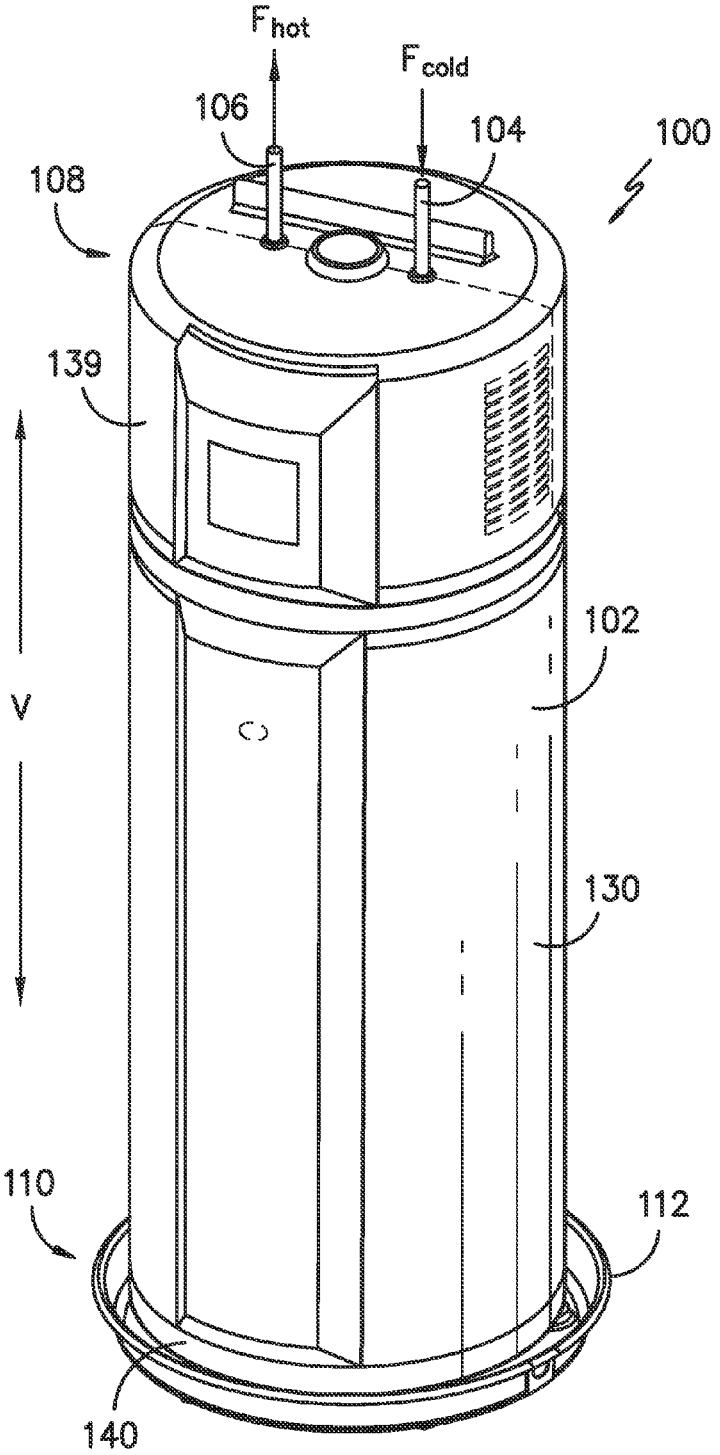
FIG. 1 is a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a water heater appliance 100 according to an exemplary embodiment of the present subject matter. Water heater 100 includes a casing 102 that generally surrounds a tank 120 and may be formed from a variety of components. As illustrated, casing 102 may include a wrapper or jacket 130 and one or more covers, such as a top cover 139 and a bottom cover 140. The covers may be coupled to the wrapper 130 to form the casing 102.

Figure 2:
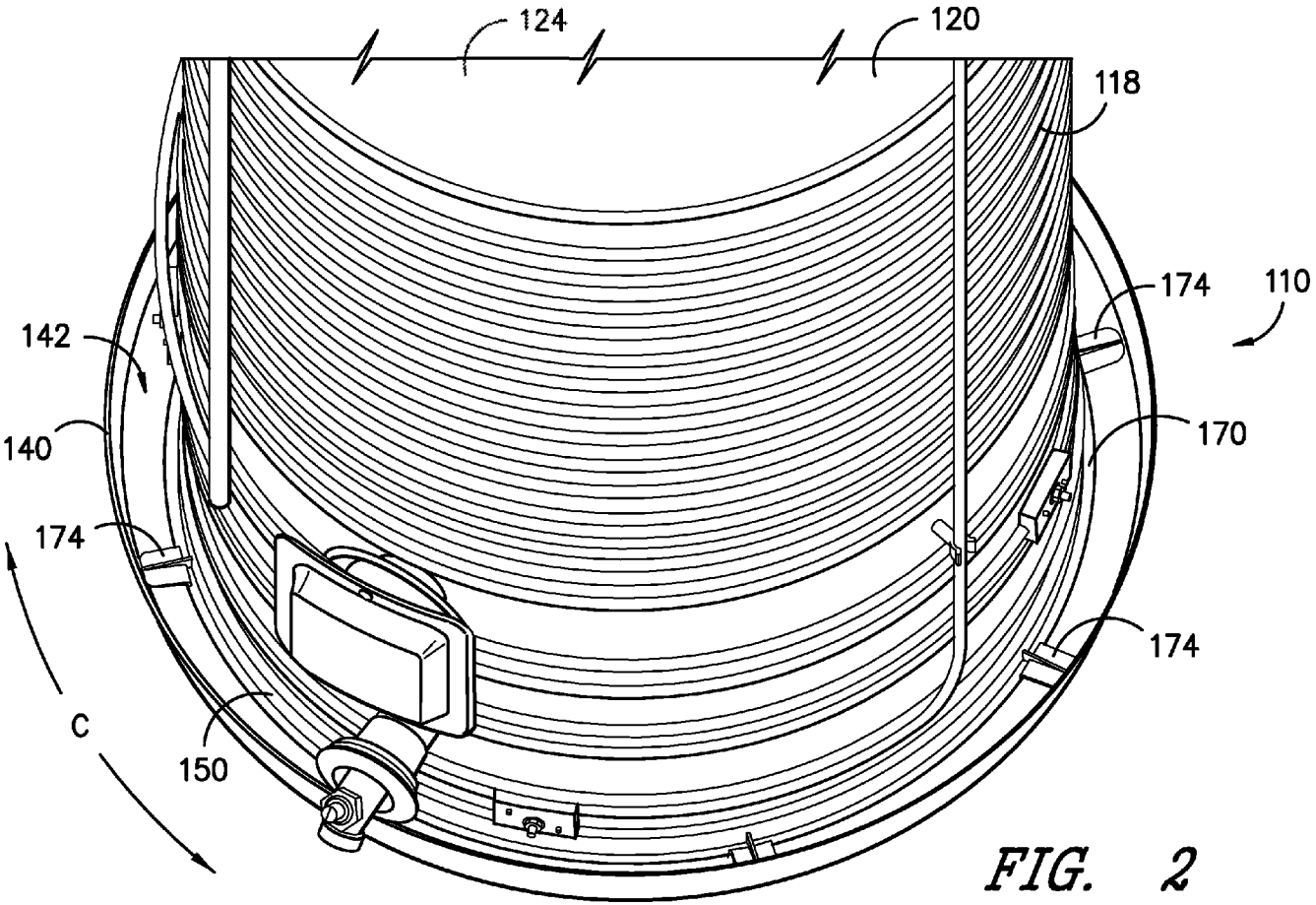
FIG. 2 is a perspective view of a bottom portion of the exemplary water heater of FIG. 1 with the wrapper of the water heater removed.

Water heater appliance 100 also includes a cold water conduit 104 and a hot water conduit 106 that are both in fluid communication with a chamber 122 (FIG. 3) defined by tank 120. As an example, cold water from a water source, e.g., a municipal water supply or a well, can enter water heater appliance 100 through cold water conduit 104 (shown schematically with arrow labeled $F_{cold}$). From cold water conduit 104, such cold water can enter chamber 122 of tank 120 wherein it is heated by a heating source, such as, e.g., hot refrigerant circulating through coils 118 (FIG. 2). Such heated water can exit water heater appliance 100 at hot water conduit 106 (shown schematically with arrow labeled $F_{hot}$) and, e.g., be supplied to a bath, shower, sink, or any other suitable feature.

Water heater appliance 100 extends longitudinally between a top portion 108 and a bottom portion 110 along a vertical direction V. Thus, water heater appliance 100 is generally vertically oriented. Water heater appliance 100 can be leveled, e.g., such that casing 102 is plumb in the vertical direction V, to facilitate proper operation of water heater appliance 100. A drain pan 112 is positioned at bottom portion 110 of water heater appliance 100 such that water heater appliance 100 sits on drain pan 112. Drain pan 112 sits beneath water heater appliance 100 along the vertical direction V, e.g., to collect water that leaks from water heater appliance 100 or water that condenses on an evaporator (not shown) of water heater appliance 100.

Referring now to FIG. 2, illustrating a perspective view of bottom portion 110 of water heater 100 with wrapper 130 removed, tank 120 for storing heated water and coils 118 are positioned within casing 102. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances. Tank 120 may have a generally cylindrically-shaped body 124 defining a radial direction R and extending vertically between a bottom 126 (FIG. 3) and a top (not shown). For this exemplary embodiment, water heater 100 is shown as a refrigerant based heat pump water heater that circulates hot refrigerant through coils 118 to transfer heat to water in tank 120. However, the present invention is not limited to heat pump water heaters. As will be understood by one of skill in the art using the teachings disclosed herein, the present invention may also be used with, e.g., water heaters that rely upon electric resistance heating elements, gas burners, and other heat sources as well.

Figure 3:
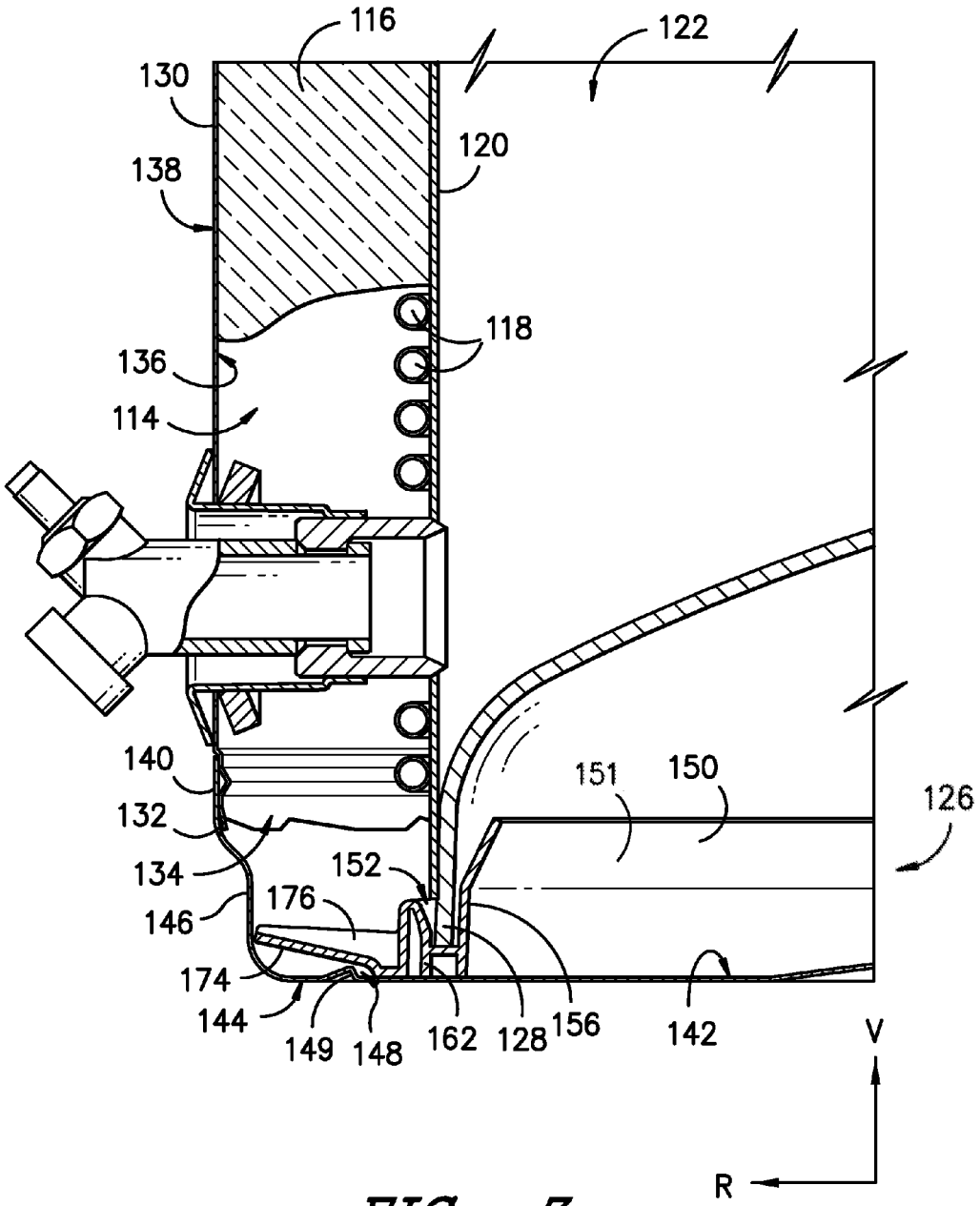
FIG. 3 is a partial cross-sectional view of the exemplary water heater of FIG. 1.

Referring now to FIG. 3, wrapper 130 extends generally along the vertical direction V between a top edge (not shown) and a bottom edge 132. When assembled, the top edge may, for example, be proximate top portion 108 of the appliance 100, and the bottom edge 132 may, for example, be proximate bottom portion 110 of the appliance 100. As shown, wrapper 130 defines a bottom opening 134 through which tank 120 is received. Bottom cover 140 is positioned at bottom opening 134 to close off opening 134.

Wrapper 130 may be a generally tubular, hollow component and in exemplary embodiments may be generally cylindrical. An interior 114 of the casing 102 may be at least partially defined by the wrapper 130, such as by an inner surface 136 of the wrapper 130. An outer surface 138 of the wrapper 130 may be opposite the inner surface 136. Insulation 116 is provided within interior 114 to reduce the amount of heat transfer to the environment. Insulation 116 can be provided as foamed-in insulation but other materials may be used as well.

It is desirable to provide conduits 104, 106 (or other features requiring connection to components provided separately from water heater 100) at a consistent location and height for water heaters 100 having the same capacity. Such consistency can improve the efficiency of the installation process by avoiding steps and/or parts that result where each installation of a water heater must be customized. For example, if each water heater 100 having a tank with a 75 gallon capacity is manufactured with features such as conduits 104, 106 at the same height and location, the piping system of residential or commercial structure can be provided with connection points that are positioned accordingly so as to expedite the installation process for an original as well as replacement water heater.

To provide conduits 104, 106 (or other features as described) at a consistent or uniform height and position on water heater 100, tank 120 must be properly centered within wrapper 130 and correctly aligned and connected with conduits 104, 106. Accordingly, referring now to FIGS. 2 and 3, water heater 100 includes a thermal barrier or centering ring 150 on which tank 120 rests. More specifically, tank 120 includes a generally circular bottom edge 128 that is received into a pocket 152 defined by centering ring 150, i.e., bottom edge 128 extends along vertical direction V into pocket 152.

As shown, bottom cover 140 includes a base portion 142 that extends along radial direction R. Base 142 is slightly arcuate along its middle and includes a ground contacting portion 144 that is located radially outward of the bottom edge 128 of tank 120 and extends circumferentially about base 142. Ground contacting portion 144 rests upon a floor or ground surface and helps support tank 120. More specifically, because ground contacting portion 144 is located radially outward of the bottom edge 128 of tank 120 and extends in a substantially horizontal manner, ground contacting portion 144 improves the stability of water heater 100 when water heater 100 is positioned vertically upright as shown in FIG. 1.

Bottom cover 140 also includes a substantially cylindrical wall portion 146 that extends circumferentially about base portion 142 around centering ring 150 and that projects along vertical direction V away from base 142 and in a direction toward wrapper 130. Wall portion 146 connects with the bottom of wrapper 130 such that bottom cover 140 closes bottom opening 134 of wrapper 130. Any suitable configuration for the connection or interface of wall portion 146 and wrapper 130 may be used.

A recess 148 is provided by bottom cover 140. Recess 148 provides a frustoconically-shaped lead-in surface 149; shapes other than frustoconical may be used for recess lead-in surface 149, including, e.g., arcuate or parabolic shapes. As shown in FIG. 3, recess lead-in surface 149 is oriented toward centering ring 150 and bottom 126 of tank 120. During assembly of water heater 100, recess 148 helps align or center centering ring 150 in bottom cover 140. Additionally, recess 148 allows for some deformation of centering ring 150 if tank 120 is out-of-round, i.e., not exactly cylindrical in shape, while keeping tank 120 centered with respect to bottom cover 140 and other components of water heater 100. That is, recess 148 accommodates deformation of centering ring 150 while maintaining the alignment of tank 120.

Figure 4:
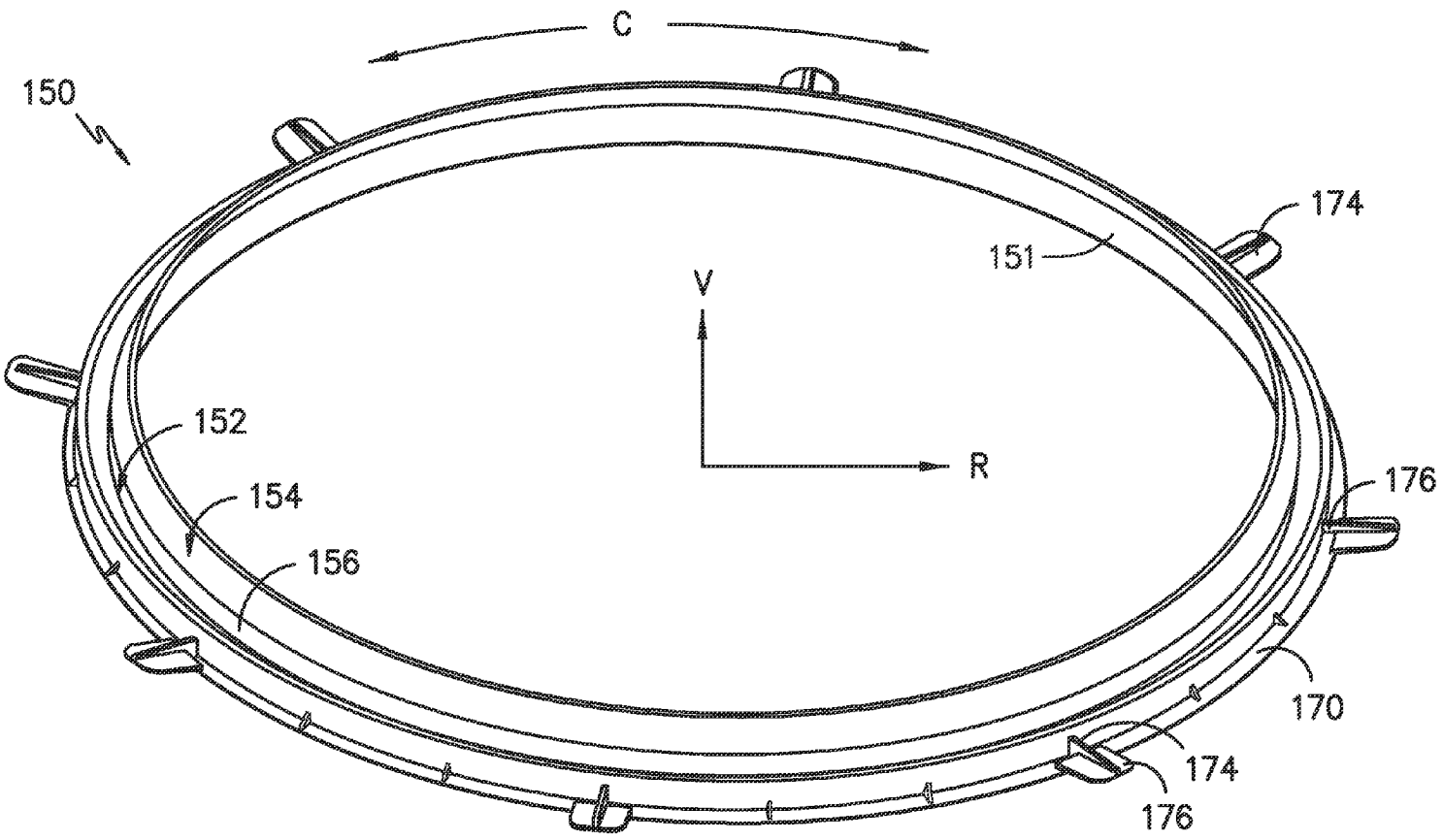
FIG. 4 is a perspective view of a thermal barrier or centering ring according to an exemplary embodiment of the present subject matter.

As described, centering ring 150 provides a pocket 152 for the receipt of the bottom edge 128 of tank 120. Referring to FIGS. 3 and 4, pocket 152 is defined by an inner wall 156, an outer wall 162, and a base surface 166 of a base 151 of centering ring 150. As shown, pocket 152 is annular or extends about base 151 of centering ring 150 along a circumferential direction C. Base surface 166 extends between walls 156, 162 along the radial direction R and circumferentially about centering ring 150. Base surface 166 defines a pocket crush rib 168 that extends circumferentially about base 151 of centering ring 150 along base surface 166 and vertically upward from base surface 166 to bottom edge 128 of tank 120. Pocket crush rib 168 deforms under the weight of tank 120 to conform to the contours of edge 128 and thereby form a barrier to assist in preventing insulation 116 from seeping or leaking radially inwardly beneath tank 120. Pocket crush rib 168 may have any appropriate shape, height, and/or configuration for preventing the intrusion of insulation 116.

Base 151 further includes an inner lead-in surface 154 defined at a top portion 158 of an inner wall 156 and positioned radially inward of edge 128. An outer lead-in surface 160 is defined at a top portion 164 of an outer wall 162 and is provided radially outside of edge 128. Thus, lead-in surfaces 154 and 160 are positioned in an opposing manner about edge 128. For the illustrated exemplary embodiment, lead-in surfaces 154 and 160 are angled or offset from the vertical direction V and are frustoconical in shape; other shapes, however, may also be used. Further, lead-in surfaces 154 and 160 may be at the same angle or different angles with respect to the vertical direction V. As also illustrated, an upper portion 155 of inner lead-in surface 152 may be at a height $H_1$ above a bottom portion 157 of inner wall 156, and an upper portion 161 of outer lead-in surface 160 may be at a height $H_2$ above a bottom portion 163 of outer wall 162. In some embodiments, height $H_1$ and height $H_2$ may be equal, and in other embodiments, such as the illustrated embodiment, one of height $H_1$ or height $H_2$ may be greater than the other.

During assembly of water heater 100, lead-in surfaces 154 and 160 assist with properly positioning tank 120 into centering ring 150. More particularly, as bottom edge 128 of tank 120 is moved into pocket 152, lead-in surfaces 154 and 160 guide edge 128 for complementary receipt into a position between the pair of opposing walls 156 and 162. As shown, walls 156 and 162 are linear in shape and extend substantially along the vertical direction V below outer lead-in surface 160 and inner lead-in surface 154, respectively.

Centering ring 150 also acts a thermal barrier in that it insulates or provides a thermal break between the bottom 126 of tank 120 and the bottom cover 140. Not only is ring 150 positioned between tank 120 and a ground or floor surface so as to reduce thermal conduction, but also base surface 166 of pocket 152 is vertically displaced from bottom cover 140, i.e., base surface 166 is elevated by a vertical distance D (FIG. 5) from bottom cover 140 to further insulate or thermally isolate tank 120. Additionally, although pocket 152 is shown extending continuously along circumferential direction C, in an alternative embodiment of the invention, pocket 152 and bottom edge 128 of tank 120 can be constructed in complementary segments or portions.

For the exemplary embodiment shown in the figures, centering ring 150 is constructed from a durable plastic material, which provides further insulation against heat loss from tank bottom 126. By way of example, polypropylene may be used in the construction of ring 150. However, other plastics may be used as well.

Figure 5:
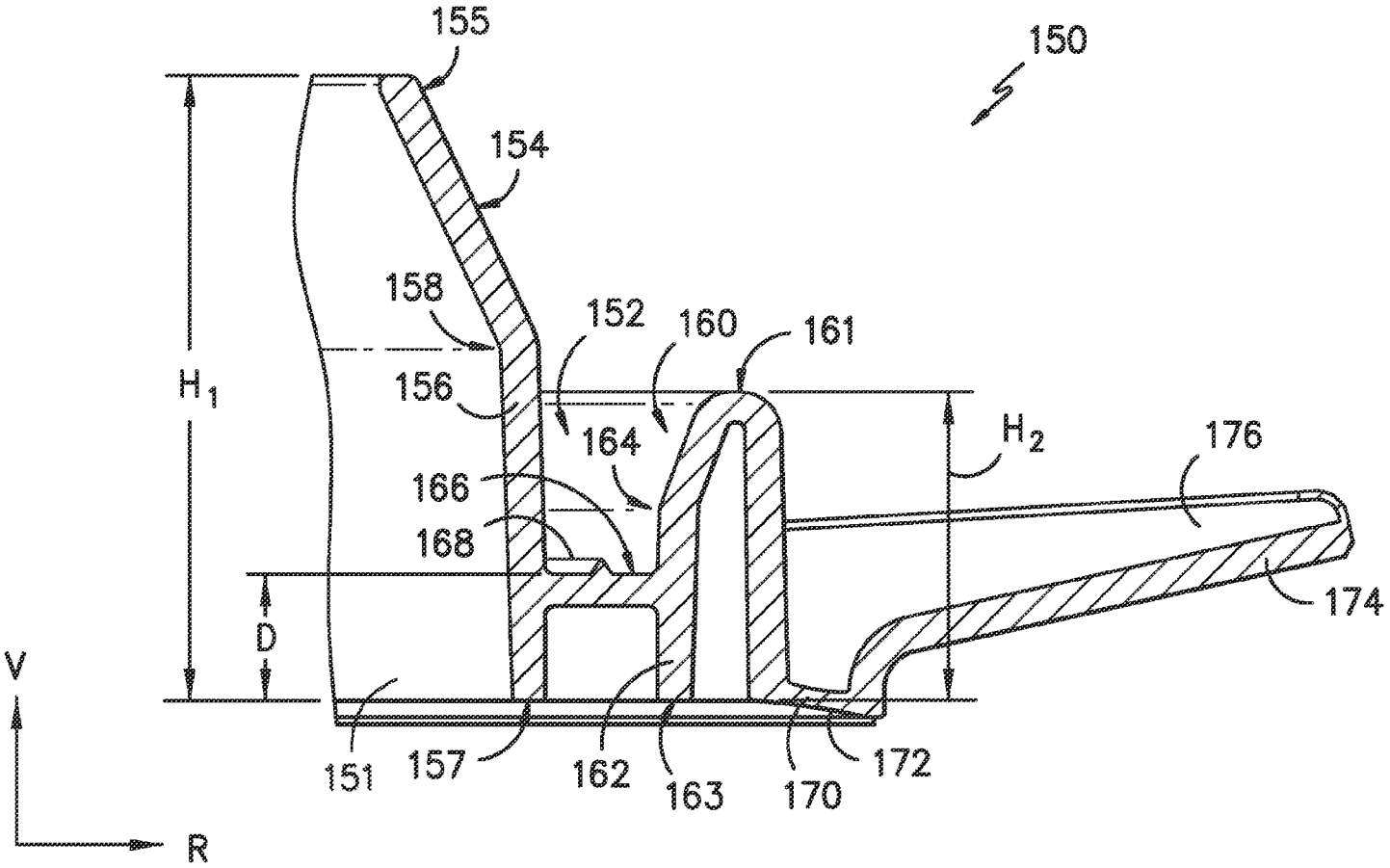
FIG. 5 is a cross-sectional view of the exemplary thermal barrier or centering ring of FIG. 4.

As indicated above, during assembly of water heater 100, interior 114 of casing 102 may be filled with a foamed-in insulation 116. In one exemplary method of construction, a precursor foam material is injected into interior 114. This foam expands substantially to form insulation 116. To contain the precursor foam material, centering ring 150 is provided with a flexible sealing flange 170 that flexes with the weight of tank 120. As shown in FIGS. 2 and 4, sealing flange 170 extends circumferentially around the periphery of base 151 of ring 150, i.e., sealing flange 170 extends radially from base 151, and is positioned in contact with bottom cover 140. Referring now to FIG. 5, sealing flange 170 defines a flange crush rib 172 projecting toward base 142 of bottom cover 140. Flange crush rib 172 deforms under the weight of tank 120 to conform to the contours of base 142 and thereby form a barrier to assist in preventing insulation 116 from seeping or leaking radially inwardly beneath centering ring 150. Flange crush rib 172 may have any appropriate shape, height, and/or configuration for preventing the intrusion of insulation 116.

As illustrated in FIGS. 2 through 5, sealing flange 170 further includes a plurality of flexible tabs or arms 174. Arms 174 are spaced apart from one another along the circumference of sealing flange 170 of centering ring 150, i.e., along the circumferential direction C. As appropriate, arms 174 may be evenly or unevenly spaced about the circumference of sealing flange 170. Further, arms 174 extend radially outwardly from sealing flange 170 to contact wall 146 of bottom cover 140. Arms 174 may flex with the weight of tank 120 and keep centering ring 150 in place with respect to, e.g., bottom cover 140 as tank 120 is lowered onto ring 150. Arms 174 may include one or more stiffening elements 176 such that arms 174 can maintain an appropriate shape or length for keeping centering ring 150 in place. Other configurations of sealing flange 170 and arms 174 may be used as well, e.g., centering ring 150 may include any appropriate number of arms 174 spaced about flange 170, and arms 174 and stiffening elements 176 may have any appropriate shape, length, or configuration to keep centering ring 150 in place as tank 120 is positioned onto ring 150.

Accordingly, centering ring 150 as described herein eliminates the need for a separate component, such as a foam centering ring, to properly center tank 120 with respect to one or more components of water heater 100, such as bottom cover 140 and wrapper 130. For example, arms 174 keep centering ring 150 in place as tank 120 is lowered onto ring 150, such that an additional foam centering ring is not needed between ring 150 and wall portion 146 of bottom cover 140 to keep ring 150 in place and properly center tank 120. Additionally, pocket crush rib 168, sealing flange 170, and flange crush rib 172 help keep insulation from leaking under tank 120 and/or centering ring 150, which could cause tank 120 to be off-centered.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A water heater comprising:

a tank having a bottom and defining a chamber for heating water, the tank also defining a vertical direction and a radial direction;

a heating source in thermal communication with the tank;

a wrapper surrounding at least a portion of the tank, the wrapper having a bottom opening;

a bottom cover positioned at the bottom opening of the wrapper to close off the bottom opening; and a centering ring onto which the bottom of the tank is positioned, the centering ring comprising:

a base having an inner wall and an outer wall and defining a base surface, the inner wall, outer wall, and the base surface defining a pocket into which the bottom of the tank is received, the pocket extending circumferentially about the base;

a sealing flange extending from the base along the radial direction; and a plurality of arms extending along the radial direction from the sealing flange.

2. The water heater of claim 1, wherein the bottom cover comprises a base portion defining a recess to accommodate deformation of the centering ring.

3. The water heater of claim 2, wherein the bottom cover comprises a wall portion extending circumferentially about the base portion of the bottom cover, and wherein the plurality of arms extend to the wall portion.

4. The water heater of claim 1, wherein the sealing flange of the centering ring defines a flange crush rib.

5. The water heater of claim 4, wherein the flange crush rib extends circumferentially about the sealing flange.

6. The water heater of claim 1, wherein the arms are spaced apart along the circumference of the centering ring.

7. The water heater of claim 1, wherein the base surface of the centering ring base defines a pocket crush rib extending along the vertical direction within the pocket.

8. The water heater of claim 7, wherein the pocket crush rib extends circumferentially about the base surface of the centering ring.

9. The water heater of claim 1, wherein the inner wall defines an inner lead-in surface positioned radially inside of the bottom of the tank.

10. The water heater of claim 1, wherein the outer wall defines an outer lead-in surface positioned radially outside of the bottom of the tank.

11. The water heater of claim 1, wherein the pocket of the centering ring is vertically displaced from the bottom cover.

12. A water heater comprising:

a tank for storing water, the tank having a bottom edge and defining a vertical direction and a radial direction;

a casing surrounding the tank and defining an interior between the tank and the casing, the casing comprising a wrapper;

insulation positioned in the interior; and a centering ring onto which the tank is positioned, the centering ring comprising a base defining a pocket into which the bottom edge of the tank is received;

a sealing flange extending along the radial direction from the base; and a plurality of arms spaced apart along the circumference of the sealing flange.

13. The water heater of claim 12, wherein the base of the centering ring comprises a pair of opposing walls extending substantially along the vertical direction and a base surface extending between the pair of opposing walls.

14. The water heater of claim 12, wherein the base of the centering ring comprises:

an inner wall having an inner lead-in surface that is offset from the vertical direction; and an outer wall having an outer lead-in surface that is offset from the vertical direction and positioned in an opposing manner to the inner lead-in surface, wherein the bottom edge of the tank is positioned between the inner wall and the outer wall.

15. The water heater of claim 14, wherein the base further comprises a base surface extending between the inner wall and the outer wall.

16. The water heater of claim 12, wherein the base defines a pocket crush rib extending within the pocket.

17. The water heater of claim 12, wherein the sealing flange defines a flange crush rib.

18. The water heater of claim 12, wherein the wrapper comprises a bottom opening, and wherein the plurality of arms extend along the radial direction from the base of the centering ring to a wall portion of the bottom cover.

* * * * *